United States Patent [19]

Grützner

[11] Patent Number: 4,584,031

[45] Date of Patent: Apr. 22, 1986

[54] USING A CORROSION PROOF AUSTENITIC ALLOY FOR HIGH LOAD WELDABLE COMPONENTS

[75] Inventor: Günter Grützner, Krefeld, Fed. Rep. of Germany

[73] Assignee: Mannesmann Aktiengesellschaft, Duesseldorf, Fed. Rep. of Germany

[21] Appl. No.: 704,205

[22] Filed: Feb. 22, 1985

[30] Foreign Application Priority Data

Feb. 24, 1984 [DE] Fed. Rep. of Germany ..... 3407305

[51] Int. Cl.[4] ..... C21D 6/02; C21D 7/02; C22C 38/48

[52] U.S. Cl. ..... 148/12 E; 148/11.5 N; 148/11.5 R; 148/12.3; 148/31; 148/38

[58] Field of Search ..... 148/12 E, 12.3, 31, 148/38, 11.5 R, 11.5 N, 39

[56] References Cited

U.S. PATENT DOCUMENTS

| | | | |
|---|---|---|---|
| 3,129,120 | 4/1964 | Smith et al. | 148/12 E |
| 3,284,250 | 11/1966 | Yeo et al. | 148/12 E |
| 4,168,190 | 9/1979 | Eguchi et al. | 148/12 E |

FOREIGN PATENT DOCUMENTS

| | | | |
|---|---|---|---|
| 55-8404 | 6/1978 | Japan | 148/12 E |

*Primary Examiner*—Wayland Stallard
*Attorney, Agent, or Firm*—Ralf H. Siegemund

[57] ABSTRACT

Corrosionproof austenitic steel is made and used by providing a particular composition and cold working and recrystallize annealling the alloy to obtain an ultrafine grain structure with average linear intercept length of grains below 10 micrometers and an increased 0.2% offset yield strength at room temperature and higher. Parts thus made are welded together using a high strength nitrogen containing corrosion resistant steel or nickel alloy as filler and the ultrafine alloy as parent metal which will not fracture in the seam transition region of the welding.

4 Claims, 2 Drawing Figures

USING A CORROSION PROOF AUSTENITIC ALLOY FOR HIGH LOAD WELDABLE COMPONENTS

BACKGROUND OF THE INVENTION

The present invention relates to the utilization of a corrosion proof austenitic iron-chromium-nickel-nitrogen alloy as structural material for components being subjected to high mechanical loads and being well amenable to welding. The chemical industry and engineering, for example, requires equipment and pressure vessel construction as well as devices for the production of energy use steel or alloys which are corrosion proof; can be welded without difficulty; and have sufficient strength comenserable with high mechanical loads. The 0.2% offset yield strength resp. the so-called 0.2 limit or yield strength resp. the yield point value are usually the requisite parameter for die calculations needed in the design. For this reason the construction engineer will prefer materials having very high 0.2% offset yield strength in order to attain restistance against highest possible load or because material and/or weight saving are required; also, thinner work pieces are easier to work and to weld. The development of such steel or alloys poses the difficult problem of maintaining or even attaining weldability of the material in spite of increased strength.

Contrary to ferritic steel, austenitic steel has quite favorable corrosion properties and is considerably better suited for welding, is more ductile and less brittle. Since nickel stabilizes the austenitic structure these steels have at least 7% nickel as for example reported in "Stahlschlüssel" 13ed., 1983 "Stahlschlüssel, Wegst GMBH Marbach, page 323 and 324 et sec. In order to obtain sufficient passivity this kind of steel has to have more than 16% chromium. In order to avoid intercrystalline corrosion the carbon content is limited to 0.08% particularly if the steel is not stabilized with titanium or niobium. A further improvement of the corrosion properties is attained through the addition of up to 6% molybdenum, up to 4% copper and up to 3% silicon. Higher nickel contents of about 50% improve the stress corrosion, see Berg- and Hüenmänische Monatshefte (BHM), 108,1963 pages 1/8 and 4 et sec.

The low guaranteed 0.2 limit of austenitic steel is stated in DIN 17 440 December issue of 1972 for steel for example from 18 to 19% chromium and about 9% nickel, to amount to 185 Newtons per square millimeter. The strength can be increased through solid solution hardening with up to 0.3% nitrogen to attain 343 Newtons per square milimeter. See also Japanese Industrial Standard JIS G4304, 19881 pages 1301/1304 et sec., SteelSUS 304 N 2. Such strength enhancement, however, does not meet all requirements.

In order to provide a further increase of the 0.2 limit it was required to introduce still more nitrogen, up to even app. 0.55% being the limit of solid solubility. Since nitrogen bubbles may accur during solidification forming blow holes in the ingot, and pores may appear during welding it is necessary to increase also the chromium and manganese content. Special steels are therefore known having from 22.5 to 25.5% chromium, from 4 to 7% manganese, from 2- to 4% molybdenum and from 13 to 17% nickel. In view of a content of nitrogen from 0.35 to 0.50% and in further view of a small amount of niobium as an additive, minimum values of the 0.2 limits are guaranteed from 500 to 540 newton per square millimeter. See also the ASM Technical Report 1970, No. C70-24.2 and the DEW Technical Reports 13, 1970, pages 94–100 and also Proceedings Molybdenum, 1973, Noranda Symposium 4, 1973, pages 43–48.

These high alloyed special steels are indeed suited for welding just as the earlier mentioned common nitrogen alloyed austenitic steel. Their pure deposited weld metals are guaranteed for a 0.2 limit of at least 510 Newtons per square millimeter. However, these special steels are disadvantaged by the fact that the high chromium and nitrogen content renders hot working difficult. Moreover as temperatures as high as 1000 degrees centigrade intermetallic phases are precipitated which phenomena is responsible for low elongations less than 30%. Moreover, after welding hot straightening or bending a certain brittleness is observed. Since chromium in steel favors the formation of ferrite while nickel supresses the ferrite formation and also delays the precipitation of intermetallic phases it is not surprizing that these alloys have also a high nickel content which of course increases the cost of such a material once more.

Chemical engineering, however, requires usually relatively low alloyed steel having for example only about 18% chromium, 10% nickel and 2% molybdenum because such a steel is sufficiently corrosion proof, at least in most instances. Even a rather low 0.2 limit of such steel amounting to about 200 Newtons per square millimeter is tolerated and one dispenses with the addition of nitrogen because the nitrogen makes hot working somewhat more difficult while increasing the 0.2% offset yield strenth only to 280 Newtons per square millimeter. Compare for example Steel 1.4435 with Steel 1.4406 as per DIN 17440.

A wide utilization of common nitrogen alloyed austenitic steel has not yet occured even though the value of the 0.2 limit was further increased up to 343 newton per square millimeter. The same is true even for higher alloyed austenitic special steels with a nitrogen content above 0.35% and minimum value of the 0.2 limit of 500 Newtons per square millimeter. The utilization of this later type of steel is inherently limited to special instances and cases because of their high costs.

Another method for improving the strength property is grain-refining due to the formation of small grains. Thus cold working and subsequent recrystallization annealing of austenitic steel with approximately 18% chromium and 10% nickel yielded an ultrafine grained structure with grains of the size number 11.5 to 13.5 in accordance with ASTM and corresponding to 6 to 3 micrometers. See also ASTM Special Technical Publication No. 369 of 1965, pages 175–179. As compared with a rather coarse-grained inital state identically with the usual solution annealed condition of austenitic steels the 0.2 limit was increased by about 150 newtown per square millimeter. Since, however, the steel was not alloyed with nitrogen its 0.2 limit was still only, as an absolute value, about 380 Newtons per square millimeter. The problem therefore as far as such extremely fine grained steel is concerned and concerning any change and amenability to welding was not discussed in that paper.

The nitrogen alloyed austenitic steel as considered thus far is also to be considered with regard to the alloying element niobium. Its effectiveness is based on the precipitation of the complex nidtride of the kind $Nb_2Cr_2N_2$ also called Z-phase. Even in hot worked solution annealed steels one obtains a grain size decrease which, however, is limited to grain sizes of No. 10 as per ASTM or corresponding 10 micrometers. See also BHM 142, 1979, page 513 et sec. In addition a certain nitride precipitation hardening was observed which increased the strength by 90 Newtons per square millimeter. See for example Thyssen Research Vol. 1, 1969, page 14 et sec. The precipitation of too much nitride has to be avoided because it extracts nitrogen from austenitic matrix as used for the solid solution hardening. In order to offset this effect these steels have a considerably smaller niobium content than their seven fold equivalent quantity of nitrogen which corresponds to the stoichiometric relation of the compound NbN.

The 0.2% offset yield strength at elevated temperature of austenitic steel is also usually increased through solid solution hardening and grainrefining. However, the increase of the 0.2 limit through the utilization of nitrogen will be lower with increasing temperature and for example at 400 degrees centigrade it is only half as large as at room temperature. See for example BHM 113, 1968, page 386 and 387 et sec. On the other hand the increase in the 0.2 limit attributable to grain-refining will decline considerably less with the test temperature as shown for example in Metal Science, Vo. 11, 1977 page 209. For still higher temperature the 0.2 limit is no longer determinative, but the somewhat lower, time dependent creep strength is decisive for design calculations. In this case the favorable small grain size effect is no longer effective.

A certain compensation can be provided through alloying with boron the alloy content being up to 0.015% because this feature increases the creep strength of austenitic chromium-nickel-molybdenum steel for temperatures of for example 650 degrees centigrade. See for example Revue Metallurgie 59, 1962, page 651/660. Even this kind of steel having additionally some nitrogen these favorable effects appear to be observed. See also Arch. Eisenhüttenwesen 39, 1968, page 146 et sec. and VDI Report 428, 1981 page 89 et sec. This way one increases the range of utilization under consideration of 0.2% offset yield strength at elevated temperature is to be considered in the calculations, and one can therefore shift the field of employment to still higher temperatures. However, it has to be observed that austenitic steel is prone to hot cracks during welding and for this reason the boron content is typically limited to 60 and 80 PPM.

Generally speaking the corrosion properties, particularly resistance against intercrystalline corrosion after welding are elaborated in DIN 17440, December issue of 1972. In particular austenitic steel alloy with up to 0.22% nitrogen is equated with steel without any nitrogen. They are both suited for welding if the wall thickness is smaller than 6 millimeters and has a carbon content below 0.07% while for thickness above 6 millimeters the carbon content even has to be below 0.03%. Only parts having 50 millimeter thickness as they are used in the pressure vessel engineering will have to be annealed after welding in accordance with the AD Flyer HP7/3 April issue of 1975.

The state of corrosion proof austenitic steel on delivery is usually determined by a treatment generally known as quenching. Basically it is a heat treatment and a healing process of at least 1000 degrees centigrade followed by very rapid cooling. This way all chromium carbides, and intermetallic phases will go into solution.

Moreover, the purpose of this feature is to remove dislocations appearing during working and as a result of deformation. These deslocations will be removed through recrystallization and recovery so that finally a state is obtained which has very low internal stress and, therefore, optimized corrosion resistance and ductility. However, one has to consider that in austenitic chromium-nickel-steel about 0.2% nitrogen and approximately 0.03% carbon are already in solution at 900 degrees centigrade. Therefore, annealing even at such relatively low temperatures in accordance with the remarks made above is still permitted if we are to make sure that for example cold worked steel will completely recrystallize at such temperatures and that before and after this heat treatment there are no intermetallic phases. Accordingly the pressure vessel engineering as per AD Flyer HP7/3 April issue of 1975 permits after cold working of nitrogen alloyed austenitic steel an annealing at 900 degrees centigrade in lieu of the quenching.

The welding connection of austenitic steel generally are evaluated by means of weld joint or weldment samples. These are flat samples in accordance with DIN 50 120 September issue of 1975 having a transverse welding seam which runs in the center and traverses the part in its entirety. Tear tests are conducted and make sure that the deposited weld metal, the parent metal and the metal in the small seam transition zone from weld to parent metal in the region of the fusion line are all subjected to the same force because they are arranged one behind another i.e., in a serial arrangement in the direction of the pulling force applied during the test. The sample and the method is in deed suitable for determining tensible strength and fracture position or location. However, it is of disadvantage that the elongation limits are ascertained only rather inaccurately by the method because the weld metal and the parent metal in the heat affected and unaffected zones will be plastically deformed differently strong within the measured length and will therefore differently extend in a permanent fashion. The fracture position in austenitic steel of usual grain size may occur in the parent metal and in the welding seam, while normally fractures are not to be expected in the seam transition zone. The strength properties are not ascertainable in this zone because they are simply too small. If a fracture occurs in the seam then of course the strength of the fusioned deposited weld metal itself is the deciding factor. Since the various filler metals are more or less fusioned with the parent metal, the tensile strength of the pure deposited metal, so-called all-weld-metal is determined separately in longitudinal samples with particularly prepared seams in order to have available sufficient reproducability of the data. In this case, no fusion occurs with the parent metal. The making of this type of longitudinal samples is described in DIN 32525, part 1, December issue of 1981.

The rate of fusion of the filler with the parent metal determined primarily by the electric current used for welding because that current determines the depth of the melted zone of the parent metal. Also the number of layers and the weld process itself are contributing factors to the rate of fusion. Furthermore, all features for reducing the overall heat input as such, and fast welding as in stringer beads low welding temperatures and avoiding the preheating are all advantage features.

In the case of a single-pass welding with the usual electric current the fusion rate are for example 20% in the tungsten-arc welding method, 30% in the manual arc welding method, 40% in the active-gas metal-arc welding method and 55% for submerged arc welding. In the case of multi-pass welding of rather thick cross sections there is a considerable reduction of this rate of fusion. On the other hand, welding of thin materials without filler metals the degree is of course 100%.

Suitability for welding of new steel is basically to be determined within the frame of so-called method tests. An important example in this connection and for austenitic steel is published in the AD Flyer HP 2/1 February issue of 1977 with the title "Method Testing of Weld Joints", (translated). This requirement refers primarily to the manufacture of test samples taken from steel welded by means of butt joints under certain conditions of manufacture so that for example parent metal, welding process, welding position, filler metals and auxiliary welding material are exactly determined. From the test sheets flat samples in accordance with DIN 50 120 are to be taken transversely to the seam, and the fracture position as well as the tensile strength is to be ascertained. The material is primarily deemed weldable if these weldment samples reach certain minimum value for the tensile strength of the effected parent metal or of the all-weld-metal, if fractures are located in the seam resp. weld metal.

DESCRIPTION OF THE INVENTION

It is an object of the present invention to provide for an increase of the heretofore low minimum value for the 0.2 limit of common nitrogen alloyed corrosion proof austenitic steel without reducing its high weldability, said minimum values to be increased to a level of approximately 500 Newtons per square millimeter without increasing the alloy content.

In accordance with the preferred embodiment of the present invention it is suggested to provide an alloy with not more than 0.08% carbon from 0.065 to 0.35% nitrogen; not more than 0.75% niobium but not more than the 4-fold amount of nitrogen used in the alloy, from 16.0 to 22.5% chromium, from 7.0 to 55.0% nickel, not more than 4.75% manganese, not more than 6.5% molybdenum, not more than 3.0% silicon, not more than 4% copper, not more than 0.008% boron, the remainder being iron and unavoidable impurities, cold working and recrystallized annealing said alloy to obtain the formation of an ultrafine grained structure with an average linear intercept length of the grains below 10 micrometers i.e. larger than No. 10 in the form ASTM. The cold working is carried out in one or multiple passes and involves from 30 to 75% deformation. After each pass there will be an annealing at a temperature from750 to 975 degrees centigrade so as to obtain ultrafine grained structure strough recrystallization.

The particular composition of the alloy as proposed is amenable to taking up high mechanical loads and is quite corrosion proof and remains very well weldable. This is due to the fact that following cold working and recrystallization annealing a high 0.2 limit is obtained due to large grain-refining. Furthermore the result is attained by the utilization of filler metals made of high strength, nitrogen containing, corrosion proof steel or nickel alloys and therefore are weldable which feature is based on the nature of the grain-refined parent metal, i.e. the alloy as such; in spite of the ultrafine grained structure of the alloy the weldment specimens will not fracture in the seam transition region, but in the unaffected grain-refined parent metal or in the seam resp. the deposited weld metal.

The grain-refining in combination with a nitrogen content of about 0.2% guarantees minimum values of the 0.2 limit of the weldments from 450 to 480 Newtons per square millimeter depending on the presence of niobium or niobium and molybdenum. The degree of cold working, the recrystallization temperature, the guaranteed minimum values of the 0.2 limits and the welding conditions are all contributing factores for obtaining the properties which make the use of the steel feasible under the conditions stated in the object.

The most important advantage of the steel in accordance with the invention is to be seen in the high 0.2 limit without reducing the weldability on account of the ultrafine grain. In accordance with general practice and knowledge it was expected that the weldability and particularly the weld joints of such extreme fine-grained, non transformable steels or alloys no longer produce a sufficient high capacity of changes in the grain-refined material and will inherently produce a coarser grain in the small heat affected zone directly at the fusion line resp. the so-called seam transition region and therefore will have relatively low strength therein. If that had occurred then the central advantage of the invention would be lost. Investigations in accordance with Table 1, however, have yielded the surprising result that the weldment specimens made in accordance with the prescriptions laid down in DIN 50 120 will not tear or rupture in the seam transition zone but in the ultrafine grained uneffected parent metal, provided the strength on account of the nitrogen solid solution hardening and the grain-refining did not exceed a particular limit. This limit is for steel with approximately 0.2% nitrogen and a tensile strength of about 825 newton per square millimeter.

DESCRIPTION OF THE DRAWINGS AND EXAMPLES

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
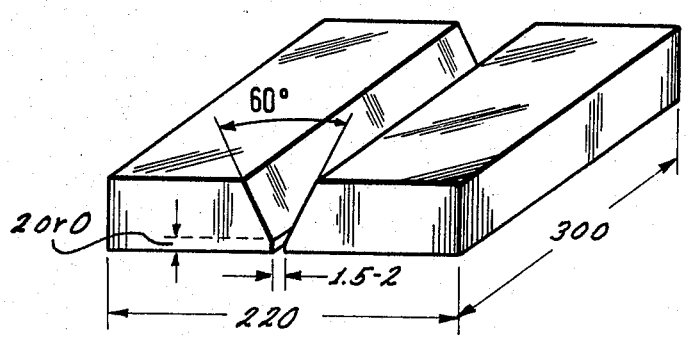
FIG. 1 is a perspective view of a test sample in preparation.

The test samples were taken from test pieces resulting from the welding of two sheets in a flat position. FIG. 1 illustrates the edge preparation. The sheets or plates being 10 millimeters thick were provided with a Y-seam ridge height of 2 millimeters, thinner sheets were provided with a V-seam i.e. without ridge. The welding was carried out in multilayers with counterlayer after the root had been ground away. After each stringer bead had been placed a delay was interposed until the welding temperature had dropped below 150 degrees centigrade. Undue seam elevations were cut off in this plain of the sheet.

The welding was carried out manual arc and at the positive terminal, with a voltage U of 23 volt and under utilization of a rutile basic rod electrode traded under the name Thermanit 20/16/510 which is available in the trade. The deposition ratio i.e. the bead length versus length of deposited filler rod portion was between 0.7 to 0.8 or 0.8 to 0.9 for the 2.5 or 3.25 millimeter electrode respectively. The other weld parameter such as DC current I, speed V, and the resulting energy input per unit length $E=U\times I\times 60/V$ was for the 2.5 millimeter rod; 80 amperes; app. 17 centimeters per minute; and app. 6.5 kilojoules per centimeter resp., while for the 3.25 millimeter electrode 110 amperes were used, for a speed app. 19 centimeter per minute which resulted in 8 kilojoules per centimeter.

The weld test were conducted so that fractures could only occur in the parent metal of the flat weldment specimen. Seam ruptures within the content of this invention would also be permissible but would not have permitted a clear presentation of the inventive concept. In the practice such cases permitting rupture of the weld seam during the test, particularly in case certain expert opinions are needed concerning the resistance against load of construction parts the 0.2 limit of the all-weld-metal may be considered controlling if the tensile strength of the weld seam of the test sample is sufficiently high even though it ruptured. In order to hold down the probability of such ruptures during test of weldments one uses a filler metal which is matched as far as its strength is concerned, the high 0.2 limit of the ultrafine grained parent metal this is a niobium containing filler metal composed in the all-weld-metal state of 0.38% nitrogen, 25% chromium, 21.5% nickel, 5% manganese, 3.6% molybdenum and 0.035% carbon, the remainder being iron.

These are the values as stated by the manufacturer for the covered rod electrode Thermanit 20/16/510. Its deposited pure weld metal has a minimum 0.2 limit of 510 Newtons per square millimeter as far as the filler rod material is concerned. See above.

In order to avoid seam ruptures it was necessary to keep low the fusion of the relatively high alloyed filler metal through a lower content in nitrogen so as to properly match the particularly proposed steel alloy in accordance with the invention and involving particularly the ultrafine grained alloy. The grain-refined structure is of course not available in the deposited weld metal. The relatively high welding speed, i.e. the large deposition ratio and the low energy input per unit length which is a measure for the amount of heat used permitted pursuant to the conducted manual arc welding, the build up the seam through many layers with little fusion occuring.

Table 2 illustrates three different alloys in accordance with the invention, one sample each which was welded in accordance with the above stated welding method. The 0.2 limit was ascertained in the test pieces after the weldments were prepared as mentioned above in connection with FIG. 1. For reasons of accuracy and reproduceability see above. The elongation limits, however, were not ascertained in flat sheet type samples but additionally from round samples taken from the same test material for a test to be conducted in accordance with DIN 50 125 April issue of 1951.

Figure 2:
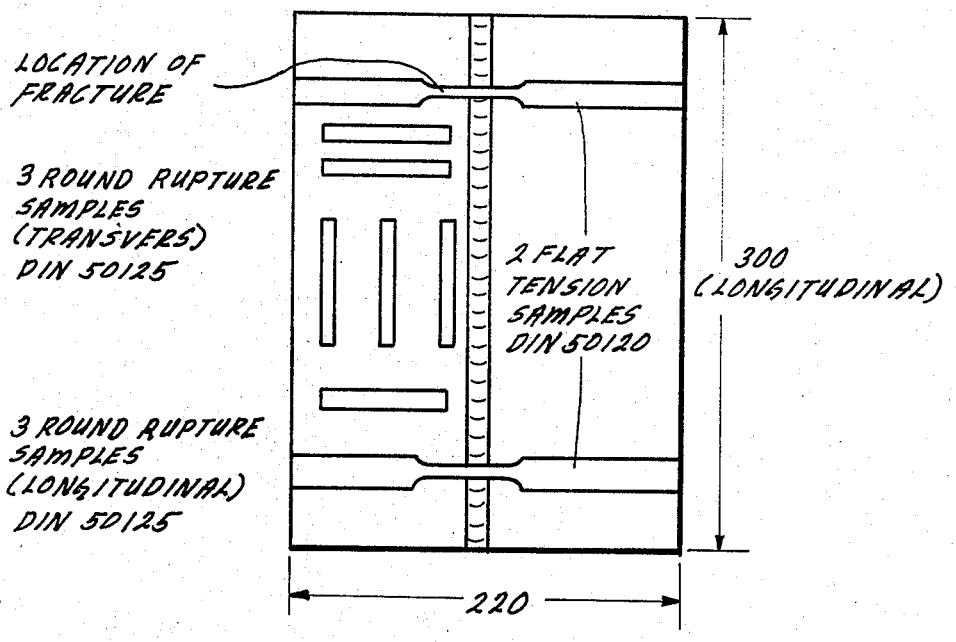
FIG. 2 is a top view of various portions and items to be taken from a prepared test sample.

FIG. 2 illustrates the position of these samples and the partitioning in the test piece. Table 2 demonstrates the advantages of the steel alloy to be used and made in accordance with the present invention. The 0.2 limits are high i.e. they have values between 504 and 553 Newtons per square millimeters. This high limit was the result primarily by superimposing the nitrogen solid solution hardening and the large grain-refining. This was obtained because the steel contained app. 0.2% nitrogen and the grain sizes were observed to be between 2.8 and 4.5 micrometers. The weldability in accordance with the invention is quite good because the weldment samples did not fracture in the seam transition region but in the uneffected parent metal. Steel without molybdenum as shown for example in the two samples 1 and 2 are therefore justified to have minimum value of the 0.2 limit of about 450 Newtons per square millimeter. The molybdenum alloy steel as per sample 3 has quite app. a 0.2 limit of at least 480 Newtons per square millimeter. This minimum values should correspond to a strength which, with such a material, can be obtained with virtual certainty.

As compared with the usual austenitic steel one has obtained therefore an increase of the 0.2 limit for app. 150% while as compared with the less common nitrogen alloyed austenitic steel one still obtains a 60% higher 0.2% offset yield strength. Cold working of the steel alloy made in accordance with the present invention and for practicing the invention is, for practical purposes, and for flat types products carried out in a Sendzimir ir Quarto type mill. Tubes should be made by cold reciprocate or pilgrims step type rolling of hot pressed hollow billets. This way one obtains further advantages, as compared with the usual, only hot work steel with larger thicknesses, such as better surface qualities, tighter tolerances in dimensions and saving of material of 5 even up to 10%.

The invention is not limited to the embodiments described above, but all changes and modifications thereof not constituting departures from the spirit and scope of the invention are intended to be included.

TABLE 1

Tensile strength R and location of fracture on the joint samples as per DIN 50 120 for manual arc welded ultrafine grained steel as per edge preparation shown in FIG. 1.
Steel composition % by weight

| | | | | Flat tension samples | | | | | | | |
|---|---|---|---|---|---|---|---|---|---|---|---|
| R | (N/mm²) | (1) | (2) | N | Nb | Cr | Ni | Mn | Mo | Si | C |
| 849 | 840 | T | 8 | 0,22 | 0,25 | 18,40 | 12,98 | 1,49 | 3,04 | 0,42 | 0,015 |
| 848 | 837 | T | 10 | 0,198 | 0,0 | 17,40 | 12,40 | 0,77 | 3,00 | 0,50 | 0,020 |
| 841 | 841 | B + T | 6 | 0,20 | 0,23 | 18,36 | 9,94 | 1,25 | 0,00 | 0,45 | 0,015 |
| 834 | 828 | B | 10 | 0,20 | 0,23 | 18,36 | 9,94 | 1,25 | 0,00 | 0,45 | 0,015 |
| 808 | 807 | B | 10 | 0,20 | 0,00 | 17,80 | 10,30 | 0,80 | 0,00 | 0,50 | 0,020 |
| 758 | 746 | B | 10 | 0,22 | 0,25 | 18,40 | 12,98 | 1,49 | 3,04 | 0,42 | 0,015 |
| 739 | 738 | B | 10 | 0,12 | 0,21 | 17,80 | 11,29 | 0,84 | 0,0 | 0,42 | 0,020 |

(1) Location of tracture, B - uneffected parent metal, T - Seam transition zone.
(2) Sheet thickness in millimeters.
Coated electrode was Thermanit 20/16/510, root and counter passes 2.5 mm diameter, filler and cap passes 3.25 mm diameter.

TABLE 2

Examples for weld joints as per DIN 50 120 of manual arc welded sheet stock comprised of ultrafine grained austenitic steel and the coated electrode TABLE 2-continued

| | Thermanit 20/10/510 Steel composition of welded sheet all percentages by weight. | | | | | | | |
|---|---|---|---|---|---|---|---|---|
| | N | Cr | Ni | Mo | Mn | Si | Nb | C |
| 1 | 0,20 | 18,38 | 9,87 | 0,0 | 1,27 | 0,42 | 0,20 | 0,015 |
| 2 | 0,20 | 21,96 | 33,45 | 0,0 | 0,69 | 0,47 | 0,37 | 0,007 |
| 3 | 0,22 | 18,40 | 12,98 | 3,04 | 1,49 | 0,42 | 0,25 | 0,015 |

| Nr. | Hot working of sheets | solution annealing | degree of cold working | recrystallization annealing | amount recrystallized |
|---|---|---|---|---|---|
| 1 | ingot rolled between 1200° and 950° C. to 10 mm | none | 55% 4,5 mm | 15 min 875° C. air cooling | 95–100% |
| 2 | ingot rolled between 1200° and 950° C. to 17 mm | none | 59% 7 mm | 15 min 875° C. air cooling | 95–100% |
| 3 | ingot rolled between 1200° and 950° C. to 22 mm | none | 55% 10 mm | 15 min 900° C. air cooling | 95–100% |

| | Round longitudinal specimens as per FIG. 2 (1) | | | |
|---|---|---|---|---|
| Nr. | Average Grain size (μm/ASTM Nr.) | 0,2 limit (N/mm²) | (%) elongation (1o = 5d) | yield point ratio (%) |
| 1 | 2,82/13,5 | 528 | 50 | 62 |
| | | 550 | 47 | 63 |
| | | 540 | 47 | 63 |
| 2 | 4,44/12 | 504 | 37,5 | 64 |
| | | 512 | 35,0 | 64 |
| 3 | 3,60/13 | 534 | 38 | 64 |
| | | 532 | 40 | 64 |
| | | 545 | 40 | 65 |

| flat weldments specimens (transverse) as per FIG. 2 | Round specimens (transverse) as per FIG. 2 (1) | | |
|---|---|---|---|
| Nr. fracture in the uneffected parent metal except when otherwise indicated Tensile strength | 0,2 limit (N/mm²) | elongation % (1o = 5d) | yield point ratio |
| 1 (a) 815 N/mm² | 523 | 50 | 63 |
| 1 (b) 823 N/mm² | 546 | 50 | 66 |
| | 530 | 50 | 53 |
| 2 (a) 767 N/mm² | 506 | 35,0 | 66 |
| 2 (b) 779 N/mm² | 505 | 35,0 | 65 |
| 3 (a) 803 N/mm² | 553 | 36 | 67 |
| (b) fractured due to lack of fusion | 553 | 36 | 67 |
| | 546 | 34 | 66 |

(1) specimens located near the fraction of the weldment in the test piece.

We claim:

1. Method of making and using weldments of a corrosion proof austenitic alloy comprising the step of providing an alloy having the following composition not more than 0.08% carbon, from 0.065 to 0.35% nitrogen; of not more than 0.75% niobium but not more than the 4-fold amount of nitrogen used in the alloy, from 16.0 to 22.5% chromium, from 7.0 to 55.0% nickel, not more than 4.75% manganese, not more than 6.5% molybdenum, not more than 3.0% silicon, not more than 4% copper, not more than 0.008 boron, the remainder being iron and unavoidable impurities; and cold working and recrystallization annealing of said alloy to attain an ultrafine grained structure with an average linear intercept length of grains below 10 micrometers and therefore obtaining increased 0.2% offset yield strength at room and elevated temperatures; and joining of said alloy in its grain-refined state through welding using a high strength, nitrogen containing, corrosion resistant steel or nickel alloy as filler metal and the ultrafine grained alloy as parent metal, which will in spite of its very small grains not fracture in the seam transition region of the weldments.

2. The method as in claim 1 said cold working involving one or several passes from 30 to 75% deformation said annealing after each pass being carried out at a temperature from 750 to 975 degrees centigrade.

3. Method as in claim 1 where said annealing lasting about one quarter of an hour at temperatures between 850 and 990 degrees centigrade.

4. The method as in claim 1 or 2 said alloy having nitrogen contents of app. 0.2% and guaranteed minimum values of the 0.2% offset yield strength in the weldments at room temperature from 450 or 480 N/mm² on the presence of niobium or niobium and molybdenum.

* * * * *